US010024604B2

(12) United States Patent
Dränkow et al.

(10) Patent No.: US 10,024,604 B2
(45) Date of Patent: Jul. 17, 2018

(54) STACKED PLATE HEAT EXCHANGER

(71) Applicant: BEHR GmbH & Co. KG, Stuttgart (DE)

(72) Inventors: Andreas Dränkow, Heimsheim (DE); Jens Richter, Groβbottwar (DE); Herbert Hofmann, Stuttgart (DE)

(73) Assignee: MAHLE INTERNATIONAL GMBH, Stuttgart (DE)

( * ) Notice: Subject to any disclaimer, the term of this patent is extended or adjusted under 35 U.S.C. 154(b) by 795 days.

(21) Appl. No.: 14/509,127

(22) Filed: Oct. 8, 2014

(65) Prior Publication Data

US 2015/0096727 A1 Apr. 9, 2015

(30) Foreign Application Priority Data

Oct. 8, 2013 (DE) ..... 10 2013 220 313

(51) Int. Cl.
*F28D 9/00* (2006.01)
*F28F 3/02* (2006.01)
*F28F 3/04* (2006.01)

(52) U.S. Cl.
CPC ..... *F28D 9/0062* (2013.01); *F28D 9/005* (2013.01); *F28F 3/025* (2013.01); *F28F 3/046* (2013.01)

(58) Field of Classification Search
CPC . F28D 9/005; F28D 9/0062; F28F 3/00–3/12; F28F 3/046; F28F 3/025
USPC ..... 165/165–167; 29/890.03–890.054
See application file for complete search history.

(56) References Cited

U.S. PATENT DOCUMENTS 4,679,410 A 7/1987 Drayer
4,781,248 A * 11/1988 Pfeiffer ..... F28D 9/005 165/166
4,966,227 A * 10/1990 Andersson ..... F28F 3/046 165/166

(Continued)

FOREIGN PATENT DOCUMENTS

DE 43 14 808 A1 11/1994
DE 10 2004 036 951 A1 5/2005

(Continued)

OTHER PUBLICATIONS

German Search Report, Appl. No. 10 2013 220 313.6, dated Feb. 25, 2014, 5 pgs.

*Primary Examiner* — Tho V Duong
(74) *Attorney, Agent, or Firm* — Paul D. Strain, Esq.; Strain & Strain PLLC

(57) ABSTRACT

The invention relates to a stacked plate heat exchanger, comprising a plurality of elongate plates which are stacked on one another and connected to one another and which have a corrugated profile, which plates have a cavity for leading through a medium to be cooled in the longitudinal direction of the plates and define a further cavity for leading through a coolant, wherein leadthrough openings for supplying or discharging the medium to be cooled or the coolant are formed approximately in the end regions of each elongate plate and each elongate plate is surrounded by a bent-off edge, wherein an nth corrugation of the corrugated profile of each plate is drawn close to the edge, preferably into the edge, whereas the other corrugations of the corrugated profile of the plate terminate before the edge, where n=2, 3, 4 etc.

8 Claims, 3 Drawing Sheets

(56) References Cited

U.S. PATENT DOCUMENTS 6,182,746 B1 * 2/2001 Wiese ..... F28D 9/005 165/166
6,394,178 B1 * 5/2002 Yoshida ..... F28D 9/005 165/166
8,061,416 B2 * 11/2011 Geskes ..... F28D 9/005 165/167
9,618,280 B2 * 4/2017 Magnier-Cathenod . F28F 3/046
2003/0215679 A1 * 11/2003 Reinke ..... F28D 9/005 122/30
2004/0031599 A1 * 2/2004 Wilson ..... F28D 9/0031 165/166
2004/0188074 A1 * 9/2004 Sabin ..... F28D 9/0037 165/166
2008/0257536 A1 * 10/2008 Kolblin ..... F28D 9/005 165/167
2008/0264618 A1 * 10/2008 Richter ..... F28D 9/005 165/166
2010/0243200 A1 * 9/2010 Baker, Jr. ..... B60H 1/00342 165/41
2011/0024095 A1 * 2/2011 Kozdras ..... F28D 9/005 165/167
2011/0290461 A1 * 12/2011 Andersson ..... F28D 9/005 165/170
2012/0267084 A1 * 10/2012 Crawford ..... F28D 9/005 165/170
2013/0192291 A1 * 8/2013 Ito ..... F28D 9/005 62/324.1
2014/0352934 A1 * 12/2014 Barone ..... B23P 15/26 165/166

FOREIGN PATENT DOCUMENTS

EP 1 376 042 A2 1/2004
GB 2 056 652 A 3/1981
WO WO 2009/080692 A1 7/2009

* cited by examiner

STACKED PLATE HEAT EXCHANGER

CROSS-REFERENCE TO RELATED PATENT APPLICATIONS

This application is based upon and claims the benefit of priority from prior German Patent Application No. 10 2013 220 313.6, filed Oct. 8, 2013, the entire contents of which are incorporated herein by reference in their entirety.

TECHNICAL FIELD

The invention relates to a stacked plate heat exchanger in accordance with the preamble of claim 1.

PRIOR ART

In cooler manufacture, stacked plate heat exchangers are sufficiently well known which cool air which is supplied to a combustion engine by means of an oil coolant or air cooling. DE 43 14 808 A1 discloses a plate heat exchanger, in particular an oil/coolant cooler, which has elongate plates which are stacked on one another and whose peripheral edges lie against one another. The plates of the heat exchanger all have the same shape. The plates have locally turbulence generating elevations in the form of knobs or sealing embossments. However, internal fittings in the form of turbulence inserts or sealing washers are also known.

DE 10 2004 036 951 A1 shows a heat exchanger which is constructed from identical plates which are stacked above one another, wherein each plate has a bent edge. In each case two plates lying above one another here form a cavity for leading through a medium to be cooled in the longitudinal direction of the plates or a further cavity for leading through a coolant. Through-openings for supplying or discharging the medium to be cooled or the coolant are formed in the end regions of each elongate plate. Here, each plate has a corrugated profile in order to ensure that the medium to be cooled or the coolant does not flow rectilinearly from the supply side to the discharge side. In the case of the stacked plate heat exchangers described, the same thermodynamic conditions are present on both fluid sides.

In order to create different thermodynamic conditions on the two fluid sides, it is necessary to use additional plates, this requiring increased outlay in terms of construction and at the same time increasing the costs of the heat exchanger.

SUMMARY OF THE INVENTION, OBJECT, ACHIEVEMENT, ADVANTAGES

It is the object of the invention to provide a stacked plate heat exchanger by means of which differentiated thermodynamic conditions are set on the two fluid sides of the stacked plate heat exchanger without further increasing the manufacturing costs.

This is achieved by the features of claim 1. One exemplary embodiment relates to a stacked plate heat exchanger in which an nth corrugation of the corrugated profile of each plate is drawn close to the edge, preferably into the edge, whereas the other corrugations of the corrugated profile of the plate terminate before the edge, where n=2, 3, 4 etc. This has the advantage that a pressure drop can be set inside the fluid duct.

Furthermore, it is advantageous if each nth corrugation of the corrugated profile of each plate is drawn close to the edge, preferably into the edge, where n=2, 3, 4 etc.

Advantageously, the plates are arranged in a block, wherein each xth plate of which the corrugated profile has at least one corrugation drawn into the edge is bounded on both sides by two plates of which the corrugations of the corrugated profile terminate before the edge. Such a stacked plate heat exchanger offers the possibility of setting two different thermodynamic conditions on the two fluid sides of the stacked plate heat exchanger without thereby requiring turbulence inserts or the installation of an external bypass. Merely as a result of the design of the different corrugations, either an internal bypass is formed on one fluid side in the vicinity of the edge of the plates or the thermodynamic conditions, such as power and pressure loss, are designed to be different as a result of the changed geometry on the two fluid sides.

In one refinement, every second plate has corrugations of the corrugated profile which are drawn into the edge. Hence, highly turbulent flows can be generated and thus variable thermodynamic conditions are produced on one fluid side of the heat exchanger. By combining two different stacked plate designs in a heat exchanger block, it is possible to form an internal bypass which is formed in particular between the corrugation and the edge of the plate, where the corrugations terminate before the edge. The second plate, which delimits this bypass and in which the corrugations are drawn into the edge, thus forms the closure of the bypass.

In one variant, the plates have a recurring corrugated profile which extends substantially transversely with respect to the main throughflow direction of the coolant or the medium to be cooled. The corrugated profile ensures that the flow profile of the coolant or the medium to be cooled does not extend rectilinearly over the longitudinal extent of the plates. As a result, the flow is multiply deflected in a cavity between two plates, which results in the coolant or the medium to be cooled being better distributed over the plate width.

In one development, the corrugated profile is corrugated in a zig-zag shape about the longitudinal extent of the plates. Here, the corrugated profile extending in a zig-zag shape is characterized by the leg length, the leg angle between adjacent legs and the profile depth.

In a further embodiment, the corrugated profile is formed as a stamping in the plates which consist of a heat-conducting material. Since this material is preferably aluminum, the stampings can be produced simply and cost-effectively in a stamping process.

Advantageously, the bent-off edges, which lie on top of one another, of the plates are brazed to one another. This ensures that no coolant and also no medium to be cooled can exit from the stacked plate heat exchanger.

In a further embodiment, the through-openings for supplying and for discharging the medium to be cooled or the coolant of each plate are situated diagonally opposite one another. This ensures that the medium to be cooled or the coolant flows through the plates over a large area, resulting in good heat exchange between the medium to be cooled and the coolant.

Further advantageous refinements are described by the following description of the figures and by the dependent claims.

BRIEF DESCRIPTION OF THE DRAWINGS

The invention is explained in more detail below on the basis of at least one exemplary embodiment with reference to the drawings, in which.

PREFERRED EMBODIMENT OF THE INVENTION

Figure 1:
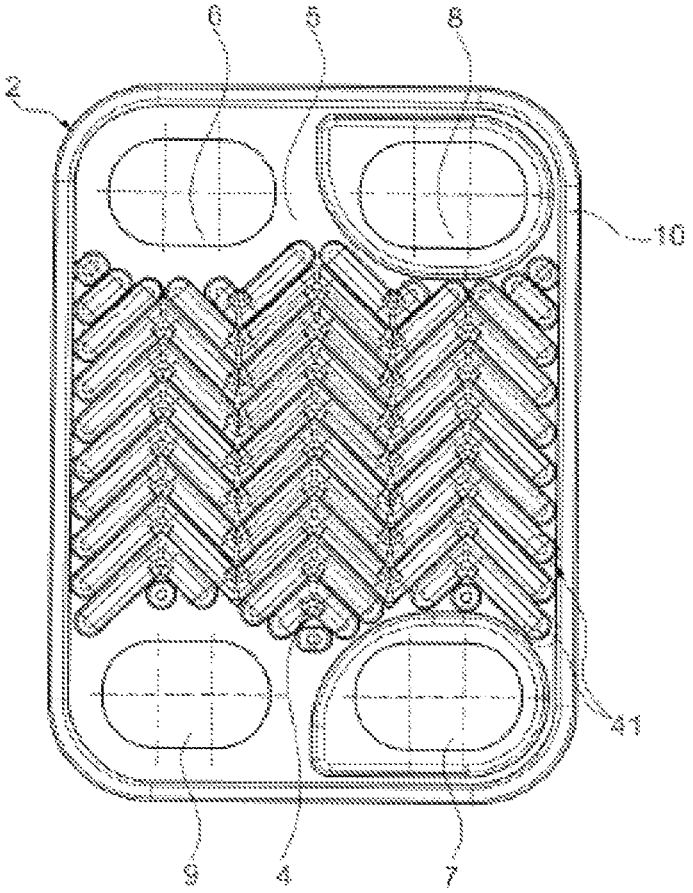
FIG. 1 shows a first exemplary embodiment of the stacked plate heat exchanger according to the invention having a first plate design.

FIG. 1 shows a first exemplary embodiment of the heat exchanger 1 according to the invention in which a plan view of a first plate 2 having a first plate design is depicted. Here, each of the plates 2 has a corrugated profile 4 of which the corrugations 42 terminate before the edge and which is stamped into a base plate 5. Leadthrough openings 6, 7, 8, 9 are in each case arranged in the vicinity of the edge of the base plates 5. The leadthrough openings 6, 7 and 8, 9 situated diagonally opposite one another form a pair, wherein the leadthrough opening 6 forms the supply for the coolant, whereas the leadthrough opening 7 forms the outflow for the coolant. Correspondingly, the leadthrough opening 9 forms the supply for the medium to be cooled, whereas the leadthrough opening 8 situated diagonally opposite forms the discharge for the medium to be cooled. Here, the leadthrough openings 7, 8 forming the outflow for the media are in each case bordered by a dome. The base plate 5 is surrounded by a peripheral bent edge 10.

Figure 2:
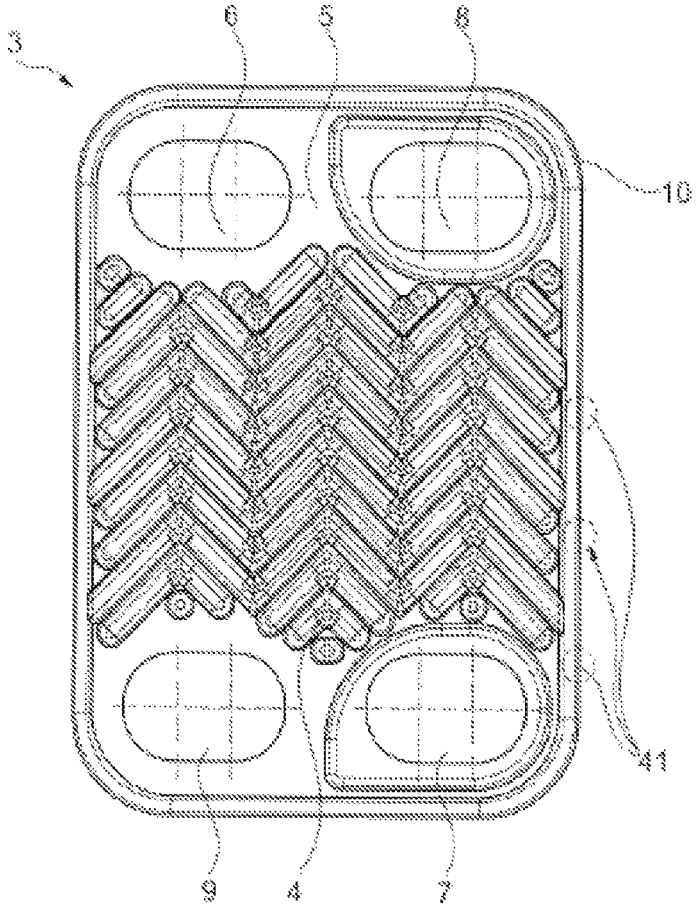
FIG. 2 shows the first exemplary embodiment of the stacked plate heat exchanger according to the invention having a second plate design.

The second plate 3, the plan view of which is shown in FIG. 2, differs from the first plate 2 shown in FIG. 1 in that it has, at least at certain points, a corrugated profile 4 in which the corrugation 41 is drawn into the edge 10. In the case of the first plate 2, the corrugations 42 of the corrugated profile 4 terminate in principle before the edge 10.

Figure 3:
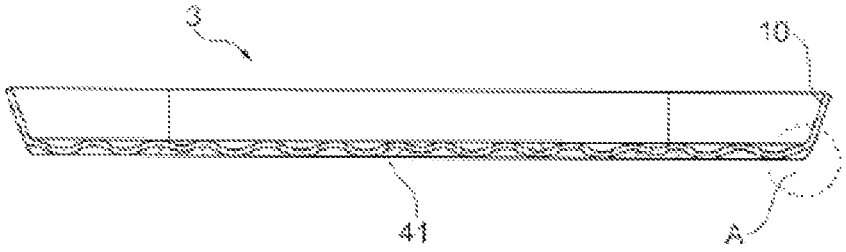
FIG. 3 shows a further exemplary embodiment of a stacked plate heat exchanger according to the invention.

FIG. 3 depicts a lateral cross section through the second plate 3 in which the corrugation 41 is drawn partially through the edge 10 and is connected thereto. Here, the corrugation 41 has a zig-zag-shaped design in the longitudinal direction of the second plate 3 and merges into the edge 10 (region A).

Figure 4:
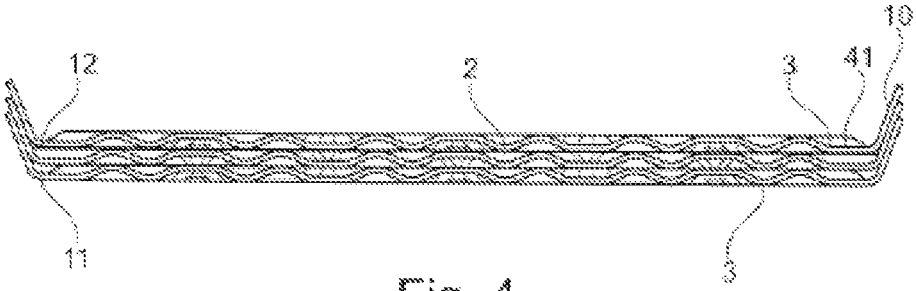
FIG. 4 shows a further exemplary embodiment of a heat exchanger according to the invention.

FIG. 4 shows a lateral cross section through the stacked plate heat exchanger 1 according to the invention in which, for example, a first plate 2 is surrounded by two second plates 3. These three plates 2, 3 lie on top of one another, wherein the edges 10 are brazed to one another. In the central, first plate 2 in which the corrugation 42 terminates before the edge 10, an interspace 11 which is used as an internal bypass 12 is formed between the last corrugation 42 and the edge 10. By virtue of the fact that the corrugations 41 of the second plates 3 situated above and below the first plate go directly into the edge 10, they thus form the closure of the bypass 12. Here, this bypass 12 can be formed on both sides of the plate 2.

Figure 5:
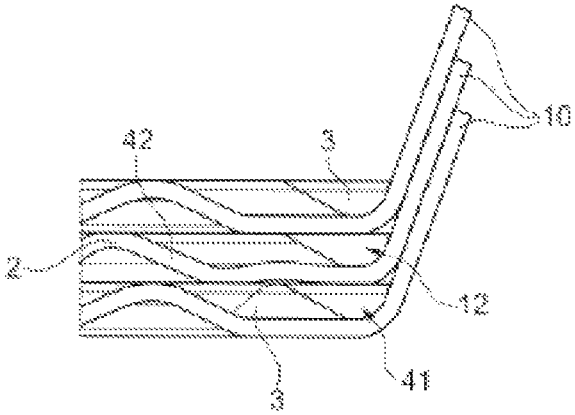
FIG. 5 shows a detail of the exemplary embodiment shown in FIG. 4.

FIG. 5 shows once again a lateral cross section depicting an enlargement of the combination of the plates 2 and 3 in which the bypass 12 is formed by the corrugation 42, which does not extend as far as the edge, of the plate 2. The bypass 12 is closed by the corrugation 41 of the plates 3 which engage directly in the edge 10.

In such a stacked plate heat exchanger 1, the pressure drop inside a fluid duct can be set. Here, two different thermodynamic fluid sides can be produced. In one fluid side, power and pressure loss are reduced, with the result that relatively high volume flows are allowed, and, on the second fluid side, the bypass serves as a power amplifier with a relatively high pressure loss, which entails relatively low volume flows.

The invention claimed is:

1. A stacked plate heat exchanger comprising:

a plurality of elongate plates stacked on top of each other and connected to one another, wherein each plate of the plurality of elongate plates has a corrugated profile, wherein adjacent plates of the plurality of elongate plates form a first cavity for leading through a cooling medium and a second cavity for leading through a coolant, wherein each plate of the plurality of elongate plates comprises lead through openings connected to the first cavity or the second cavity, wherein the lead through openings are formed approximately in the end regions of each plate of the plurality of elongate plates and each elongate plate is surrounded by a bent-off edge, wherein the first cavity is arranged in a longitudinal direction extending between lead through openings on opposite end regions of the plurality of elongate plates, wherein each plate of the plurality of elongate plates comprises a corrugated profile having a plurality of corrugations, wherein an xth plate of the plurality of elongate plates has at least one corrugation drawn into its bent-off edge, wherein said xth plate is bounded on a top side and a bottom side by two plates of the plurality of elongate plates which have a corrugated profile having corrugations that all terminate before the bent-off edges of the two plates, wherein the x in xth is an integer such that the plurality of elongate plates has a repeating pattern of plates having at least one corrugation drawn into their bent-off edges and plates having a corrugated profile having corrugations that all terminate before their bent-off edges, wherein an nth corrugation of the corrugated profile of the xth plate is drawn into the bent-off edge, whereas corrugations other than the nth corrugation of the corrugated profile of the plate terminate before the bent-off edge, wherein the n in nth is an integer such that the corrugated profile has a repeating pattern of corrugations drawn into the edge and corrugations terminating before the edge.

2. The stacked plate heat exchanger according to claim 1, wherein x is 2 such that every second plate has corrugations of the corrugated profile which are drawn into the edge.

3. The stacked plate heat exchanger according to claim 1, wherein the corrugations of each plate of the plurality of elongate extend from a first lateral bent-off edge to a second lateral bent-off edge transversely with respect to a main through flow direction of the coolant or the cooling medium.

4. The stacked plate heat exchanger according to claim 3, wherein the corrugations comprise a zig-zag shape about the direction of longitudinal extent of the plates.

5. The stacked plate heat exchanger according to claim 1, wherein the corrugated profile is formed as a stamping in the plates which consist of a heat-conducting material.

6. The stacked plate heat exchanger according to claim 1, wherein the bent-off edges, which lie on top of one another, of the plates are brazed to one another.

7. The stacked heat exchanger according to claim 1, wherein the lead through openings for supplying and for discharging the medium to be cooled or the coolant of each plate are situated diagonally opposite one another.

8. A stacked plate heat exchanger comprising:

a plurality of elongate plates stacked on top of each other and connected to one another, wherein each plate of the plurality of elongate plates has a corrugated profile, wherein adjacent plates of the plurality of elongate plates form a first cavity for leading through a cooling medium and a second cavity for leading through a coolant, wherein each plate of the plurality of elongate plates comprises lead through openings connected to the first cavity or the second cavity, wherein the lead through openings are formed approximately in the end regions of each plate of the plurality of elongate plates and each elongate plate is surrounded by a bent-off edge, wherein the first cavity is arranged in a longitudinal direction extending between lead through openings on opposite end regions of the plurality of elongate plates, wherein each plate of the plurality of elongate plates comprises a corrugated profile having a plurality of corrugations, wherein an xth plate of the plurality of elongate plates has at least one corrugation drawn into its bent-off edge, wherein said xth plate is bounded on a top side and a bottom side by two plates of the plurality of elongate plates which have a corrugated profile having corrugations that all terminate before the bent-off edges of the two plates, wherein the x in xth is an integer such that the plurality of elongate plates has a repeating pattern of plates having at least one corrugation drawn into their bent-off edges and plates having a corrugated profile having corrugations that all terminate before their bent-off edges, wherein an nth corrugation of the corrugated profile of the xth plate is drawn into the bent-off edge, whereas corrugations other than the nth corrugation of the corrugated profile of the plate terminate before the bent-off edge, wherein the n in nth is an integer such that the corrugated profile has a repeating pattern of corrugations drawn into the edge and corrugations terminating before the edge, wherein the corrugations of each plate of the plurality of elongate extend from a first lateral bent-off edge to a second lateral bent-off edge transversely with respect to a main through flow direction of the coolant or the cooling medium, wherein the corrugations comprise a zig-zag shape about the direction of longitudinal extent of the plates.

* * * * *